US005611186A

United States Patent [19]

Weaver

[11] Patent Number: 5,611,186

[45] **Date of Patent: *Mar. 18, 1997**

[54] LAMINATED ROOFING SHINGLE

[75] Inventor: Casimir P. Weaver, Northport, Ala.

[73] Assignee: Elk Corporation of Dallas, Dallas, Tex.

[ * ] Notice: The term of this patent shall not extend beyond the expiration date of Pat. No. 5,369,929.

[21] Appl. No.: 347,032

[22] Filed: Nov. 30, 1994

Related U.S. Application Data

[63] Continuation-in-part of Ser. No. 189,796, Feb. 1, 1994, Pat. No. 5,369,929.

[51] Int. Cl.[6] ..... E04D 1/28

[52] U.S. Cl. ..... 52/557; 52/314; 52/518; 52/554

[58] Field of Search ..... 52/314, 315, 518, 52/554, 555, 557

[56] References Cited

U.S. PATENT DOCUMENTS

D. 102 8/1861 Rickerby .
D. 2,297 5/1866 Clark et al. .
D. 15,359 8/1884 Strover .

(List continued on next page.)

FOREIGN PATENT DOCUMENTS 0963626 3/1975 Canada .

OTHER PUBLICATIONS

*Contractors Guide*, Aug. 1988 Georgia Pacific Advertisement (2 sheets).
Brochure GS Roofing Products Company High Sierra™ Premier Heavyweight Laminated Shingles Advertisement (1 sheet).
Video entitled "3M/IMP Roofing Granules IMP".
Brochure Pabco Roofing Products "PABCO® HM–30™ Extra Protectoin, Durability and Beauty" (4 sheets).
Brochure Pabco Roofing Products "PABCO® HO–25™ Protection and Beauty Beyond the Ordinary" (2 sheets).
Brochure Pabco Roofing Products "PABCO® SG–25™ Extra Proecton and Longer Life" (2 sheets).
Brochure Pabco Roofing Products "PABCO® GG–20™ The Most Economical U/L Class 'A' Roof" (4 sheets).
Brochure Owens/Corning Fiberglas™ "Oakridge™ Dimensional Shingles" Apr. 1988 (10 sheets).
Brochure Atlas Roofing Corporation "Residential Roofing Products" pp. 1–8.
Brochure Dura Ridge (2 sheets).
Brochure TrendRidge® (2 sheets).
Brochure Tamko Roofing Products "Residential Roofing Products" 1990 (10 sheets).

(List continued on next page.)

*Primary Examiner*—Carl D. Friedman
*Assistant Examiner*—Kevin D. Wilkens
*Attorney, Agent, or Firm*—Baker & Botts, L.L.P.

[57] ABSTRACT

A shingle is provided having a headlap section and a buttlap section with at least one portion of the buttlap section having a relatively uniform color and/or value and an adjacent portion of the buttlap section having a value gradation from light to dark. A plurality of horizontal striations with transition stripes disposed between adjacent horizontal striations may be used to establish the desired value gradation. An illusion of depth or thickness is created on the portion of the buttlap section having the value gradation. The buttlap section defines in part the exposed weather surface of the associated shingle. The relatively uniform color and/or value portions may be formed on tabs or dragon teeth and the value gradation formed on a backer sheet disposed beneath the tabs. Openings between adjacent tabs expose the associated enhanced value gradation to view. The amount of contrast between adjacent striations may be substantively increased to create the desired illusion of depth or thickness while the transition stripes provide a subtle change in value from one striation to the next striation. The number of horizontal striations and their width may also be varied to provide the desired value gradation.

25 Claims, 6 Drawing Sheets

U.S. PATENT DOCUMENTS

| | | |
|---|---|---|
| 19,880 | 4/1858 | Smith . |
| D. 20,695 | 4/1891 | Frand . |
| Re. 24,246 | 12/1956 | Fink . |
| D. 35,195 | 10/1901 | Barrett . |
| D. 35,592 | 1/1902 | Murdock . |
| D. 38,931 | 12/1907 | Dickelman . |
| D. 39,890 | 3/1909 | Pedlar . |
| D. 41,353 | 5/1911 | Vogan . |
| D. 42,101 | 1/1912 | Annis . |
| D. 45,836 | 5/1914 | Goldberg . |
| D. 48,172 | 11/1915 | Dunlany . |
| D. 51,438 | 10/1917 | Caron . |
| D. 52,538 | 10/1918 | Lords . |
| D. 53,015 | 2/1919 | Overbury et al. . |
| D. 53,086 | 3/1919 | Overbury . |
| D. 53,087 | 3/1919 | Overbury . |
| D. 53,102 | 3/1919 | Creighton . |
| D. 53,103 | 3/1919 | Creighton . |
| D. 54,160 | 11/1919 | Woodruff . |
| D. 54,917 | 4/1920 | Heppes . |
| D. 56,106 | 8/1920 | Russell . |
| D. 57,865 | 5/1921 | Scharwath . |
| D. 57,866 | 5/1921 | Scharwath . |
| D. 61,363 | 8/1922 | Butterick . |
| D. 67,565 | 6/1925 | Abbey et al. . |
| D. 68,522 | 10/1925 | Dohm . |
| D. 68,552 | 10/1925 | Sjodahl . |
| D. 70,986 | 8/1926 | Sjodhal . |
| D. 70,987 | 8/1926 | Sjodahl . |
| D. 70,988 | 8/1926 | Sjodahl . |
| D. 70,989 | 8/1926 | Sjodahl . |
| D. 74,467 | 2/1928 | Abraham . |
| D. 74,669 | 3/1928 | Fife . |
| D. 75,433 | 6/1928 | Kelly . |
| D. 75,612 | 6/1928 | Cotner . |
| D. 75,761 | 7/1928 | Abraham . |
| D. 75,762 | 7/1928 | Abraham . |
| D. 76,843 | 11/1928 | Topping . |
| D. 77,213 | 12/1928 | Abraham . |
| D. 77,218 | 12/1928 | Caron . |
| D. 77,277 | 12/1928 | Welch . |
| D. 77,786 | 2/1929 | Melby . |
| D. 81,200 | 5/1930 | Naterman . |
| D. 81,712 | 7/1930 | Moone . |
| D. 81,768 | 8/1930 | Topping . |
| D. 83,624 | 3/1931 | Ledeboer . |
| D. 83,704 | 3/1931 | Stark . |
| D. 83,718 | 3/1931 | Brown . |
| D. 84,668 | 7/1931 | Ralph . |
| D. 85,638 | 12/1931 | Finley . |
| D. 85,639 | 12/1931 | Finley . |
| D. 86,085 | 1/1932 | Guy . |
| D. 86,194 | 2/1932 | Brown . |
| D. 87,104 | 6/1932 | Eckert . |
| D. 88,995 | 1/1933 | Tobin . |
| D. 89,471 | 3/1933 | Streeter et al. . |
| D. 89,639 | 4/1933 | Humphrey . |
| D. 89,783 | 5/1933 | Moone . |
| D. 90,115 | 6/1933 | Harshberger . |
| D. 91,061 | 11/1933 | Fife . |
| D. 91,654 | 3/1934 | Harshberger . |
| D. 91,744 | 3/1934 | Topping . |
| D. 92,132 | 5/1934 | Holdsworth . |
| D. 92,250 | 4/1935 | Harshberger . |
| D. 92,379 | 5/1934 | Topping . |
| D. 92,380 | 5/1934 | Topping . |
| D. 92,504 | 6/1934 | Topping . |
| D. 92,632 | 6/1934 | Topping . |
| D. 93,191 | 8/1934 | Topping . |
| D. 93,642 | 10/1934 | Topping . |
| D. 95,242 | 4/1935 | Goslin . |
| D. 95,731 | 5/1935 | Cahill et al. . |
| D. 95,824 | 6/1935 | Harshberger . |
| D. 96,547 | 8/1935 | Harshberger . |
| D. 99,248 | 4/1936 | Piazza . |
| D. 99,249 | 4/1936 | Piazza . |
| D. 101,732 | 10/1936 | Clow . |
| D. 101,921 | 11/1936 | MacLean . |
| D. 104,095 | 4/1937 | Fife . |
| D. 104,948 | 6/1937 | Mickelson . |
| D. 104,971 | 6/1937 | Logan . |
| D. 105,124 | 6/1937 | Molyneux . |
| D. 107,209 | 11/1937 | Batell . |
| D. 109,077 | 3/1938 | Foley . |
| D. 112,998 | 1/1939 | Hunker . |
| D. 119,439 | 3/1940 | Ritter . |
| 121,063 | 11/1871 | Pierce . |
| 126,547 | 5/1872 | Hickcox . |
| D. 127,883 | 6/1941 | Johnston . |
| D. 131,018 | 1/1942 | Coburn . |
| D. 135,035 | 2/1943 | Humphrey . |
| D. 135,045 | 2/1943 | Bigler et al. . |
| D. 142,479 | 10/1945 | Heinning . |
| D. 143,400 | 1/1946 | Coburn . |
| D. 143,401 | 1/1946 | Coburn . |
| D. 143,402 | 1/1946 | Coburn . |
| D. 143,403 | 1/1946 | Coburn . |
| D. 143,404 | 1/1946 | Coburn . |
| D. 144,378 | 4/1946 | Harris . |
| D. 153,983 | 5/1949 | Rysdon . |
| D. 160,866 | 11/1950 | Kellogg . |
| D. 161,210 | 12/1950 | Ruggles . |
| D. 161,945 | 2/1951 | Lorenz . |
| D. 164,271 | 8/1951 | Abraham . |
| D. 164,317 | 8/1951 | Papesh . |
| D. 166,761 | 5/1952 | Langville . |
| D. 167,474 | 8/1952 | Nettles . |
| D. 168,668 | 1/1953 | Berini . |
| D. 173,327 | 10/1954 | Robert . |
| D. 173,332 | 10/1954 | Volk . |
| D. 177,808 | 5/1956 | Helt et al. . |
| D. 178,450 | 8/1956 | Butler . |
| D. 182,401 | 4/1958 | Borger et al. . |
| D. 186,086 | 9/1959 | Hadders . |
| 188,447 | 3/1877 | Walton . |
| D. 195,334 | 6/1963 | Brockman . |
| D. 199,939 | 12/1964 | Sewell . |
| D. 200,299 | 2/1965 | Pannullo et al. . |
| D. 208,294 | 8/1967 | Dallaire . |
| D. 208,887 | 10/1967 | Gillis . |
| D. 209,719 | 12/1967 | Ellis . |
| D. 211,214 | 5/1968 | Bull . |
| D. 212,874 | 12/1968 | Tiverton et al. . |
| D. 222,119 | 9/1971 | Green . |
| D. 235,254 | 6/1975 | Luther . |
| D. 247,786 | 4/1978 | Flood . |
| D. 250,848 | 1/1979 | Naslund . |
| D. 251,808 | 5/1979 | Patenaude . |
| D. 256,953 | 9/1980 | Morita . |
| D. 256,954 | 9/1980 | Morita . |
| D. 265,510 | 7/1982 | Bedwell, Jr. . |
| D. 272,767 | 2/1984 | Nemeth . |
| D. 274,947 | 7/1984 | Culpepper, Jr. et al. . |
| D. 277,411 | 1/1985 | Spinelli et al. . |
| D. 282,287 | 1/1986 | McKeagan et al. . |
| D. 288,771 | 3/1987 | Kero . |
| D. 300,257 | 3/1989 | Stahl . |
| D. 309,027 | 7/1990 | Noone et al. . |
| D. 313,278 | 12/1990 | Noone . |
| D. 313,658 | 1/1991 | Noone . |
| D. 314,439 | 2/1991 | Jenkins et al. . |
| D. 314,628 | 2/1991 | Jenkins et al. . |

| | | |
|---|---|---|
| 315,061 | 4/1885 | Perkins . |
| D. 317,506 | 6/1991 | Jenkins et al. . |
| D. 320,091 | 9/1991 | Paquette . |
| D. 326,330 | 5/1992 | Klein . |
| D. 331,812 | 12/1992 | Bunger . |
| 335,342 | 2/1886 | Daugherty . |
| D. 336,347 | 6/1993 | Hannah et al. . |
| D. 339,875 | 9/1993 | Schutz et al. . |
| D. 340,294 | 10/1993 | Hannah et al. . |
| D. 341,667 | 11/1993 | Schultz et al. . |
| D. 344,144 | 2/1994 | Weaver et al. . |
| D. 347,900 | 6/1994 | Stapleton . |
| 553,514 | 1/1896 | Crawford . |
| 614,478 | 11/1898 | Johnston . |
| 716,585 | 12/1902 | Schneider . |
| 748,141 | 12/1903 | Zwerk . |
| 876,098 | 1/1908 | Savery . |
| 891,501 | 6/1908 | Overbury . |
| 957,623 | 5/1910 | Oesterheld . |
| 978,333 | 12/1910 | Overbury . |
| 1,096,267 | 5/1914 | Sammis . |
| 1,108,236 | 8/1914 | Reynolds . |
| 1,115,866 | 11/1914 | Reynolds . |
| 1,150,298 | 8/1915 | Overbury . |
| 1,154,334 | 9/1915 | Overbury . |
| 1,157,665 | 10/1915 | Becker . |
| 1,208,595 | 12/1916 | McKay . |
| 1,219,652 | 3/1917 | McKay . |
| 1,256,384 | 2/1918 | Simonson . |
| 1,295,360 | 2/1919 | Overbury . |
| 1,318,238 | 10/1919 | Speer . |
| 1,345,627 | 7/1920 | Overbury . |
| 1,351,181 | 8/1920 | McKay . |
| 1,368,947 | 2/1921 | Levis . |
| 1,379,368 | 5/1921 | Speer . |
| 1,389,979 | 9/1921 | Rahr et al. . |
| 1,410,867 | 3/1922 | Abraham . |
| 1,414,778 | 5/1922 | Elvidge . |
| 1,425,564 | 8/1922 | Whiteside . |
| 1,431,103 | 10/1922 | Donahue . |
| 1,434,332 | 10/1922 | Elvidge . |
| 1,442,614 | 1/1923 | Hooker . |
| 1,443,774 | 1/1923 | Weber . |
| 1,450,731 | 4/1923 | Maclean . |
| 1,464,492 | 8/1923 | Busha . |
| 1,464,493 | 8/1923 | Busha . |
| 1,464,494 | 8/1923 | Busha . |
| 1,466,077 | 8/1923 | Wardell . |
| 1,467,779 | 9/1923 | Dremann . |
| 1,472,270 | 10/1923 | Harshberger . |
| 1,483,046 | 2/1924 | Ritter . |
| 1,494,788 | 5/1924 | Kromenaker et al. . |
| 1,494,789 | 5/1924 | Abraham . |
| 1,495,070 | 5/1924 | Finley . |
| 1,496,108 | 6/1924 | Wilson et al. . |
| 1,508,365 | 9/1924 | Lukens, Jr. et al. . |
| 1,516,243 | 11/1924 | Perry . |
| 1,518,857 | 12/1924 | Layton . |
| 1,533,969 | 4/1925 | Busha . |
| 1,544,956 | 7/1925 | Torbert . |
| 1,555,441 | 9/1925 | Sjodahl . |
| 1,582,281 | 4/1926 | Kridler et al. . |
| 1,584,023 | 5/1926 | Fischer . |
| 1,601,731 | 10/1926 | Flood . |
| 1,604,339 | 10/1926 | Cumfer . |
| 1,604,708 | 10/1926 | Mills, Jr. . |
| 1,604,745 | 10/1926 | Finley . |
| 1,612,776 | 12/1926 | Kirschbraun . |
| 1,627,665 | 5/1927 | Overbury . |
| 1,629,146 | 5/1927 | Busha . |
| 1,629,287 | 5/1927 | Milligan . |
| 1,631,936 | 6/1927 | Ritter . |
| 1,633,474 | 6/1927 | Busha . |
| 1,638,746 | 8/1927 | Robinson . |
| 1,642,148 | 9/1927 | Guy . |
| 1,648,692 | 11/1927 | McCarthy . |
| 1,650,285 | 11/1927 | Lindley . |
| 1,655,885 | 1/1928 | Adair . |
| 1,657,271 | 1/1928 | Nelson . |
| 1,666,429 | 4/1928 | Stolp, Jr. . |
| 1,672,713 | 6/1928 | Durbin . |
| 1,690,792 | 11/1928 | Neptune . |
| 1,701,640 | 2/1929 | Sherriff . |
| 1,705,497 | 3/1929 | Overbury . |
| 1,722,702 | 7/1929 | Kirschbraun et al. . |
| 1,729,212 | 9/1929 | Fisher . |
| 1,741,403 | 12/1929 | Caton . |
| 1,741,539 | 12/1929 | Richardson . |
| 1,741,566 | 12/1929 | Harris . |
| 1,742,724 | 1/1930 | Perry . |
| 1,748,981 | 3/1930 | Harris . |
| 1,756,476 | 4/1930 | Audet . |
| 1,765,796 | 6/1930 | Kirschbraun . |
| 1,767,374 | 6/1930 | Kirschbraun . |
| 1,768,280 | 6/1930 | Arcidiacono . |
| 1,772,487 | 8/1930 | Horne . |
| 1,772,924 | 8/1930 | Weller . |
| 1,776,949 | 9/1930 | Lombard . |
| 1,791,571 | 2/1931 | Overbury . |
| 1,794,719 | 3/1931 | MacLean . |
| 1,800,403 | 4/1931 | Pfaff et al. . |
| 1,802,868 | 4/1931 | Black . |
| 1,805,292 | 5/1931 | Mosher . |
| 1,825,575 | 9/1931 | Butterick . |
| 1,842,761 | 1/1932 | McCarthy . |
| 1,843,370 | 2/1932 | Overbury . |
| 1,846,635 | 2/1932 | Finley . |
| 1,850,680 | 3/1932 | Levin . |
| 1,857,463 | 5/1932 | MacLean . |
| 1,862,852 | 6/1932 | Harshberger . |
| 1,873,944 | 8/1932 | Black . |
| 1,898,989 | 2/1933 | Harshberger . |
| 1,913,768 | 6/1933 | Moone . |
| 1,915,964 | 6/1933 | Wall . |
| 1,920,474 | 8/1933 | Martin . |
| 1,924,650 | 8/1933 | Payne . |
| 1,927,436 | 9/1933 | Fischer . |
| 1,928,285 | 9/1933 | Fischer . |
| 1,928,835 | 10/1933 | Levis . |
| 1,935,656 | 11/1933 | Mortimer . |
| 1,936,327 | 11/1933 | Fischer . |
| 1,937,933 | 12/1933 | Yeager . |
| 1,958,560 | 5/1934 | Beckman . |
| 1,959,960 | 5/1934 | Magrath . |
| 1,961,005 | 5/1934 | Levin . |
| 1,974,047 | 9/1934 | Harshberger . |
| 1,993,134 | 3/1935 | Ford . |
| 1,994,643 | 3/1935 | Harshberger . |
| 2,006,270 | 6/1935 | Harshberger . |
| 2,013,002 | 9/1935 | Logan . |
| 2,013,391 | 9/1935 | Searls . |
| 2,035,921 | 3/1936 | Quinn . |
| 2,036,329 | 4/1936 | Giles . |
| 2,037,507 | 4/1936 | Fischer . |
| 2,045,423 | 6/1936 | Topping . |
| 2,050,218 | 8/1936 | Abraham . |
| 2,051,818 | 8/1936 | Buczkowski . |
| 2,058,578 | 10/1936 | Eckert . |
| 2,068,118 | 1/1937 | Topping . |
| 2,068,767 | 1/1937 | Robert . |
| 2,070,571 | 2/1937 | Beasley . |
| 2,074,684 | 3/1937 | Eckert . |
| 2,075,058 | 3/1937 | Robinson . |
| 2,078,998 | 5/1937 | Black . |

2,084,981 6/1937 Anderson .
2,086,137 7/1937 Ritter .
2,094,059 9/1937 Buczkowski .
2,096,968 10/1937 Johnston .
2,097,546 11/1937 Brown .
2,099,131 11/1937 Miller .
2,100,830 11/1937 Altheide .
2,103,076 12/1937 Harshberger et al. .
2,104,067 1/1938 Bailey .
2,109,447 2/1938 Sadtler .
2,110,258 3/1938 Blank .
2,111,565 3/1938 Limerick .
2,111,798 3/1938 Miller et al. .
2,112,194 3/1938 Harshberger .
2,112,861 4/1938 O'Hagen et al. .
2,113,644 4/1938 Bollaert .
2,114,450 4/1938 MacLean .
2,127,199 8/1938 Austhoff .
2,128,836 8/1938 McVoy .
2,129,288 9/1938 Shattuck .
2,131,043 9/1938 Harshberger et al. .
2,132,999 10/1938 Topping .
2,142,177 1/1939 Clapp .
2,142,181 1/1939 Croce .
2,148,167 2/1939 Lyman .
2,150,883 3/1939 O'Reilly .
2,161,440 6/1939 Venrick .
2,168,217 8/1939 Kirschbraun .
2,168,955 8/1939 Karan .
2,170,534 8/1939 MacNutt .
2,171,010 8/1939 Schuetz et al. .
2,171,746 9/1939 Guiterman .
2,174,098 9/1939 Stein .
2,182,444 12/1939 McKinnie .
2,182,526 12/1939 Rumer .
2,187,139 1/1940 Rowe .
2,187,203 1/1940 Johnston .
2,190,654 2/1940 Eichhorn .
2,196,420 4/1940 Matthews .
2,196,847 4/1940 Austin .
2,197,972 4/1940 Ernst .
2,198,466 4/1940 Stolze .
2,199,760 5/1940 Schuetz .
2,201,175 5/1940 Harshberger .
2,201,442 5/1940 Mabie, Jr. .
2,202,830 6/1940 Bussey .
2,205,679 6/1940 Ames, Jr. .
2,206,915 7/1940 Ochs .
2,243,256 5/1941 Miller .
2,250,764 7/1941 Hoess .
2,253,652 8/1941 Ritter .
2,260,446 10/1941 Fooks, Jr. et al. .
2,276,170 3/1942 Elmendorf .
2,284,705 6/1942 Wickersham .
2,285,480 6/1942 Wilde .
2,290,420 7/1942 Fasold .
2,302,183 11/1942 Burns .
2,307,734 1/1943 DeVault .
2,323,230 6/1943 McAvoy .
2,335,493 11/1943 Drinkall .
2,336,191 12/1943 Rose .
2,340,038 1/1944 Buczkowski et al. .
2,347,250 4/1944 Burnett .
2,348,223 5/1944 Papesh .
2,370,803 3/1945 Kronenbitter .
2,371,180 3/1945 Moeller .
2,421,766 6/1947 Turman .
2,437,874 3/1948 Black .
2,438,099 3/1948 Whitehouse .
2,661,303 12/1953 Fasold et al. .
2,818,824 1/1958 Read et al. .
3,001,331 9/1961 Brunton .
3,091,898 6/1963 Fasold et al. .
3,104,184 9/1963 Wengenroth .
3,111,788 11/1963 Ouellet .
3,166,872 1/1965 Cacossa .
3,200,552 8/1965 Steck .
3,233,382 2/1966 Graveley, Jr. .
3,237,361 3/1966 Norman, Jr. .
3,247,631 4/1966 Lovness .
3,252,257 5/1966 Price et al. .
3,262,239 7/1966 Mills .
3,267,834 8/1966 Hockett .
3,269,075 8/1966 Marini et al. .
3,347,001 10/1967 Cosden .
3,363,380 1/1968 Merrill .
3,376,683 4/1968 Epstein .
3,377,762 4/1968 Chalmers et al. .
3,380,215 4/1968 Schaefer et al. .
3,407,556 10/1968 Leibrook .
3,412,518 11/1968 Waite .
3,422,589 1/1969 Harrison .
3,468,092 9/1969 Chalmers .
3,484,267 12/1969 Sadler, III .
3,507,079 4/1970 George .
3,593,479 7/1971 Hinds et al. .
3,605,369 9/1971 Merrill et al. .
3,613,328 10/1971 Morgan, Jr. et al. .
3,624,975 12/1971 Morgan et al. .
3,626,439 12/1971 Kneisel .
3,640,035 2/1972 Butterfield .
3,640,044 2/1972 Watts .
3,667,184 6/1972 Merrill et al. .
3,763,609 10/1973 Probst .
3,783,570 1/1974 Storch .
3,797,179 3/1974 Jackson .
3,897,667 8/1975 Turek .
3,899,855 8/1975 Gadsby .
3,903,340 9/1975 Shepherd .
3,919,823 11/1975 Bradley .
3,921,358 11/1975 Bettoli .
3,927,501 12/1975 Allen et al. .
3,973,369 8/1976 Smith .
4,001,997 1/1977 Saltzman .
4,015,374 4/1977 Epstein et al. .
4,079,561 3/1978 Vallee .
4,143,499 3/1979 Näslund .
4,186,538 2/1980 Marcum, Jr. .
4,188,762 2/1980 Tellman .
4,188,763 2/1980 Thiis-Evensen .
4,194,335 3/1980 Diamond .
4,195,461 4/1980 Thiis-Evensen .
4,198,257 4/1980 Plaff .
4,261,152 4/1981 Tellman .
4,262,466 4/1981 Roe .
4,266,388 5/1981 Flood .
4,274,243 6/1981 Corbin et al. .
4,295,445 10/1981 Kopenhaver .
4,301,633 11/1981 Neumann .
4,317,853 3/1982 Thiis-Evensen .
4,322,928 4/1982 Freiborg .
4,333,279 6/1982 Corbin et al. .
4,352,837 10/1982 Kopenhaver .
4,399,186 8/1983 Lauderback .
4,404,783 9/1983 Freiborg .
4,405,680 9/1983 Hansen .
4,468,903 9/1984 Eaton et al. .
4,468,909 9/1984 Eaton .
4,499,701 2/1985 Bockwinkel et al. .
4,499,702 2/1985 Turner .
4,527,374 7/1985 Corbin .
4,559,267 12/1985 Freshwater et al. .
4,571,356 2/1986 White et al. .
4,611,451 9/1986 Symbold .

| | | |
|---|---|---|
| 4,637,191 | 1/1987 | Smith . |
| 4,672,790 | 6/1987 | Freiborg . |
| 4,717,614 | 1/1988 | Bondoc et al. . |
| 4,729,814 | 3/1988 | Jennus et al. . |
| 4,768,318 | 9/1988 | Freiborg . |
| 4,817,358 | 4/1989 | Lincoln et al. . |
| 4,835,929 | 6/1989 | Bondoc et al. . |
| 4,848,057 | 7/1989 | MacDonald et al. . |
| 4,869,942 | 9/1989 | Jennus et al. . |
| 5,052,162 | 10/1991 | Bush et al. . |
| 5,181,361 | 1/1993 | Hannah et al. . |
| 5,195,290 | 3/1993 | Hulett . |
| 5,209,802 | 5/1993 | Hannah et al. . |
| 5,232,530 | 8/1993 | Malmquist et al. . |
| 5,369,929 | 12/1994 | Weaver et al. . |

OTHER PUBLICATIONS

Color photograph of three–tab shingle produced by 3M with the edges of the tabs cut off (1 sheet).
Color photograph of three–tab shingle produced by 3M (1 sheet).
Color photograph of three tab shingles produced by 3M (1 sheet).
Eighteen photographs of shingles as a result of several focus group surveys on a wide variety of shingles, conducted by BJS III Marketing of Duncanville, Texas.
Pages from "Tonal Values, How to See Them, How to Paint Them" by Angela Gair (cover page and pp. 6, 18, 29, 30 and 43).
Pages from North Light Art School, "Observation & Drawing" (cover page, front page and p.10, 11 and 33).
*Contractors Guide*, Aug. 1988—Georgia Pacific advertisement.
Brochure, Residential Roofing Products "The Stars of our line are Helping Keep America Beautiful".
Advertisement, The Ruberoid Co., *American Builder*, Apr. 1952.
Advertisement, The Ruberoid Co., *Sweet's Catalogue File*, 1952.
Brochure, Carey Fire Chex Roofing, 1966.
The Ruberoid Co. Annual Report 1941 to Stockholders and Employees.
Brochure, Carey, The Philip Carey Mfg. Company.
Advertisement, GAF Timberline "Natural Shadow" Timberline Series.
Advertisement, GAF "The Roof the Neighbors Look Up To".
Picture, Fire–Chex 400.
Picture, Rustic Shakes.
Brochure, GAF Timberline Series Ultra "Natural Shadow," 1994.
Brochure, GAF Timberline Ultra "Natural Shadow," 1993.
Brochure, GAF Timberline Ultra "Natural Shadow" Color Selector, 1994.
Brochure, GAF "Natural Shadow," 1994.
Brochure, GAF, "The Roof the Neighbors Look Up To.", 1994.
Brochure, GAF, The GAF Timberline Series, "Natural Shadow, 1994".
Brochure, GAF Residential Roofing, 1993.
Color copy of two photographs of pages from the 1966 *Philip Carey* Catalogue and the 1967 *Sweets* Catalogue (1 sheet).
Celotex Brochure (2 pages), Jun. 1982.
*Roofs Catalogue by the Flintkote Company*, Jul. 1929, p. 20, slate–tone shingles illustration at top center (Copy in Group 290).
Color copy of five photographs of pages from *Carey® Fire–Chex Roofing* Catalogue (1957 *Sweets* Catalogue (2 sheets).
1982 *Sweets* Catalogue File, Products for Light Residential Construction 7.7 Jo, p. 2 illustration (copy in Group 290).
1982 *Sweets* Catalogue File, Products for Light Residential Construction 7.7 Jo, p. 4, The Woodlands Roof (copy in Group 290).
Copy of *Carey® Fire–Chex Roofing* Catalogue Form No. 6295–57–956–NL (from 1957 *Sweets* Catalogue)(20 sheets).
Copy of *Carey® Fire–Chex Roofing* Catalogue From 1967 *Sweets* Catalogue (47M–936–HC) (8 pages).
The Roofing Collection®, CertainTeed, HORIZON Shangle®, 1991, CertainTeed Corporation.
Copy of Photograph of 3M three tab shingle.
*Asphalt Roofing Manufacturers Association*, "Residential Asphalt Roofing Manual," Cover page through 7, © 1984, 1988.
*Elk Corporation*, "Prestique ®, High Definition Shingles," ™ 1991 Elk Corporation.

66
50
54
56
52
100
30
64
30
62
50
60
56
54
52
55
53

86
80
90
91
94
96
91
98
91
96
91
94
92
92
82
88
186
84

56
157
155
54
153
151
52
84
154
152

LAMINATED ROOFING SHINGLE

RELATED APPLICATION

This application is a continuation-in-part of U. S. patent application Ser. No. 08/189,796 filed Feb. 1, 1994, entitled *Laminated Roofing Shingle*, of same assignee, now U.S. Pat. No. 5,369,929 dated Dec. 6, 1994. This application is also related to design patent application Ser. No. 07/762,857 filed Sep. 18, 1991 entitled *Laminated Shingle*, now U.S. Design Pat. No. D344,144, and pending patent application Ser. No. 08/318,901 filed Oct. 5, 1994, entitled *Laminated Roofing Shingle*, now abandoned in favor of continuing application Ser. No. 08/521,235 filed Aug. 30, 1995.

TECHNICAL FIELD OF THE INVENTION

This invention relates to an improved roofing product, and in particular, to a shingle having an enhanced gradation of color values to create the illusion of thickness or depth on a relatively flat surface.

BACKGROUND OF THE INVENTION

Asphalt roofing products are often divided into three broad groups: shingles, roll roofing and underlayment. Shingles and roll roofing typically functions as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long term ability to resist weathering and to provide stability under the anticipated temperature extremes. An outer layer of mineral granules is also commonly applied to the asphalt coating to form a surface exposed to the weather which shields the asphalt coating from the sun's rays, adds color to the final product and provides fire resistance.

Asphalt shingles are one of the most commonly used roofing materials. Such shingles are typically manufactured as strip shingles interlocking shingles and large individual shingles in a variety of weights and colors. Such asphalt shingles are also often referred to as composite shingles. Even though composite and/or asphalt shingles offer significant cost, service life and flammability advantages over wood shingles, wood shingles are still often preferred due to the pleasing aesthetic appearance of a wood shingled roof. An important aesthetic advantage of such wood shingles is their greater thickness as compared to composite shingles. The thickness of wood shingles results in a more pleasing, layered look for the finished roof.

Value is an indication of the relative darkness or lightness of a color. The human eye is capable of seeing a wide range of color values. As wood shingles age or weather, they produce an infinite variety of subtle changes in value which provide a pleasing aesthetic appearance. Also, changes in both lighting and naturally occurring shadows associated with relatively thick wood shingles further enhances their generally pleasing aesthetic appearance.

Various composite shingles have been developed to provide an appearance of thickness comparable to wood shingles. Examples of such composite or asphalt shingles are shown in U.S. Pat. No. 5,232,530 entitled *Method of Making a Thick Shingle*; U.S. Pat. No. 3,921,358 entitled *Composite Shingle*; U.S. Pat. No. 4,717,614 entitled *Asphalt Shingle*; and design and U.S. Pat. Des. No. 309,027 entitled *Tab Portion of a Shingle*. These above-referenced patents are incorporated by reference for all purposes within this application. Also, the *Residential Asphalt Roofing Manual* published by the Asphalt Roofing Manufacturers Association provides excellent information on various types of shingles and other roofing products.

SUMMARY OF THE INVENTION

In accordance with the present invention, a shingle is provided to substantially reduce or eliminate the shortcomings previously associated with the appearance of composite and/or asphalt shingles. In accordance with one aspect of the present invention, transition stripes may be disposed between horizontal striations to provide a value gradation with enhanced differences in contrast on portions of a shingle to create the illusion of thickness or depth on a relatively flat surface. The use of transition stripes prevents the enhanced difference in contrast from presenting a confused or disjointed appearance. The resulting shingle provides the appearance of depth or thickness often associated with wood shingles.

The present invention may be used with various roofing products including laminated shingles having tabs or dragon teeth extending from a first shingle sheet with the tabs disposed on top of a second shingle sheet. The first shingle sheet may sometimes be referred to as a dragon tooth strip and the second shingle sheet may sometimes be referred to as a "backer strip".

In accordance with another aspect of the present invention, a shingle may be provided having an exposed surface or weather surface with alternating first portions of relatively uniform value adjacent to second portions having an enhanced value gradation from light to dark. If desired, the relatively uniform value portions or first color portions may vary in contrast with respect to each other and the enhanced value gradation portions or the second color portions may also vary with respect to each other.

One embodiment of the present invention includes a laminated shingle having a plurality of dragon teeth with openings therebetween. A backer strip is preferably disposed under the dragon teeth with portions of the backer strip exposed through the openings between the dragon teeth. Each dragon tooth preferably has a relatively uniform value and/or color. The color and value of adjacent dragon teeth may vary as desired. The exposed portions of the associated backer strip preferably have an enhanced value gradation from light to dark to create the desired illusion of depth. The present invention offers an increased range of values for any selected color using a manageable number of different horizontal striations and transitions stripes to produce the desired visual appearance.

Technical advantages of the present invention may include providing a laminated shingle with an enhanced value graduation formed by a plurality of horizontal striations on a backer strip with a large difference in contrast or value between the lightest striation and the darkest striation. The number and width of the horizontal striations formed on the backer strip may be varied to provide the enhanced gradation in value from light to dark to create the desired illusion of depth or thickness. A transition stripe may be formed between adjacent horizontal striations to further enhance the desired value gradation between horizontal striations having a large difference in contrast. By providing one or more transition stripes in accordance with the teachings of the present invention, horizontal striations having a high difference between light and dark values may be satisfactorily used to produce a pleasing subtle shading effect associated with wood shingles while at the same time allowing the use of the enhanced value gradation associated with high contrasts. For some applications the large difference in contrast between the lightest striation and the darkest striation would produce a confused and disjointed appearance instead of providing the desired appearance without the use of transition stripes disposed between adjacent horizontal striations in accordance with the teachings of the present invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
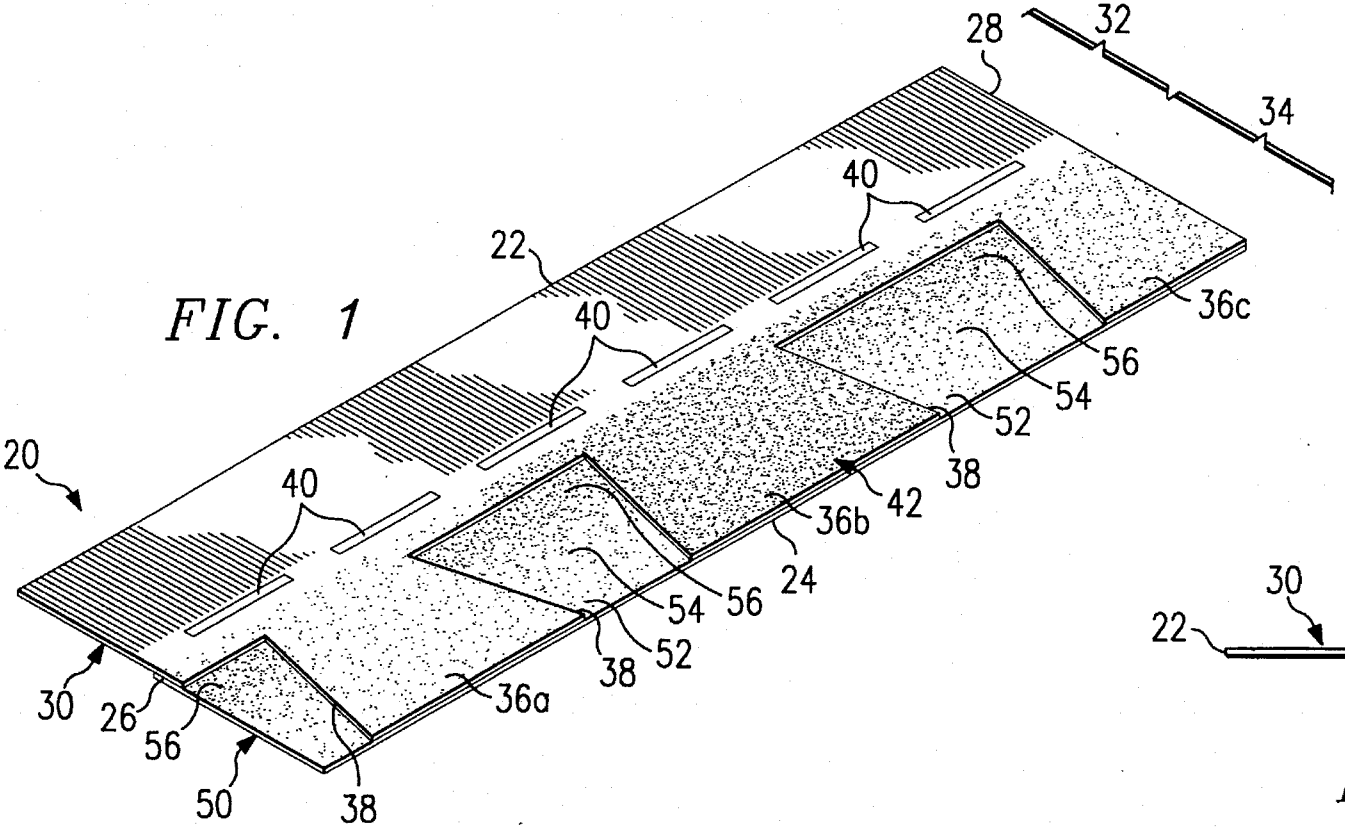
FIG. 1 is a perspective view of a single laminated shingle incorporating one embodiment of the present invention.
Figure 4:
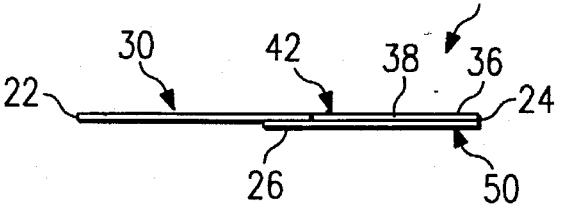
FIG. 4 is a left side view of the shingle of FIG. 1.

The preferred embodiments of the present invention and its advantages are best understood by referring to FIGS. 1–8 of the drawings, like numerals being used for like and corresponding parts of the various drawings.

Laminated shingle 20 incorporating one embodiment of the present invention is shown in FIGS. 1–4. Laminated shingle 20 preferably comprises first shingle sheet 30 and second shingle sheet 50, which cooperate with each other to provide headlap section 32 and buttlap section 34. First shingle sheet 30 has a generally rectangular configuration comprising headlap section 32 with a plurality of tabs 36 extending therefrom to partially define buttlap section 34. For purposes of explanation, tabs 36 are further designated respectively as 36*a*, 36*b* and 36*c*. Tabs 36 may also be referred to as "dragon teeth". A plurality of openings 38 may be formed between adjacent tabs 36. Second shingle sheet 50 also has a generally rectangular configuration and may be disposed beneath tabs 36 with portions of second shingle sheet 50 exposed through the associated openings 38.

Various techniques such as a self-sealing adhesive strip (not shown) may be used to attach second shingle sheet 50 to the underside of first shingle sheet 30. The resulting laminated shingle 20 has a generally rectangular configuration defined in part by longitudinal edges 22 and 24 with lateral edges 26 and 28. Longitudinal edge 22 defines in part the upper edge of the resulting laminated shingle 20. Longitudinal edge 24 defines in part the lower edge or leading edge of laminated shingle 20. A plurality of self sealing adhesive strips 40 are preferably disposed on the exterior of first shingle sheet 30 between headlap section 32 and buttlap section 34.

First shingle sheet 30 may sometimes be referred to as a "dragon tooth sheet". Second shingle sheet 50 may sometimes be referred to as a "backer strip". Also, openings 38 formed between adjacent tabs 36 with portions of backer strip 50 disposed thereunder may sometimes be referred to as "valleys." Depending upon the desired application and appearance of each shingle 20, tabs 36 may have equal or different widths and may have a square, rectangular, trapezoidal, or any other desired geometric configuration. In the same respect, openings 38 may have equal or different widths and may have a square, rectangular, trapezoidal or any other desired geometric configuration. As will be explained later in more detail, laminated shingles 20 may be fabricated from sheet 80 of roofing material shown in FIG. 6A with tabs 36 and openings 38 formed as a "reverse image" of each other.

For one embodiment of the present invention, laminated shingle 20 may be formed from a fiberglass mat (not shown) with an asphalt coating on both sides of the mat. If desired, the present invention may also be used with shingles formed from organic felt or other types of suitable base material. The present invention is not limited to use with shingles having a fiberglass mat.

The exposed outer surface or weather surface 42 for shingle 20 is defined in part by tabs 36 and the portions of backer strip 50 which are exposed through openings 38 between adjacent tabs 36. Weather surface 42 of laminated shingle 20 may be coated with various types of mineral granules to protect the associated asphalt coating, to add color to laminated shingle 20 and to provide fire resistance. For some applications, ceramic coated mineral granules may be used to form the outer layer comprising weather surface 42. Also, a wide range of mineral colors from white and black to various shades of red, green, yellow, brown, blue and any combination thereof may be used to provide the desired color or colors for shingle 20. The underside of shingle 20 may be coated with various inert minerals with sufficient consistency to seal the associated asphalt coating.

An important feature of the present invention includes providing a plurality of horizontal striations on the surface of second shingle sheet 50 which is exposed through respective openings 38. For the embodiment of the present invention shown in FIGS. 1 through 4, second shingle sheet 50 has three horizontal striations 52, 54 and 56. These horizontal striations 52, 54 and 56 preferably provide a value gradation from light starting at leading edge 24 to dark at the upper portion of each opening 38.

The number of horizontal striations and the width of each striation on backer strip 50 may be varied depending upon the desired aesthetic appearance of the resulting laminated shingle 20. For some applications, the value gradation formed on second shingle sheet 50 may include ten or fifteen striations with each striation having a width of one quarter of an inch to one half an inch. Also, each striation may have a different color and/or value to establish the desired amount of contrast. Contrast for purposes of this patent application is defined as the degree of difference in the value between areas of light and dark.

For some applications, a gradual change in contrast associated with a large number of striations may provide the appearance of depth or thickness associated with wood or other natural products. Also, the amount or degree of contrast in the value gradation exposed in each opening 38 may be varied depending upon the desired aesthetic appearance. An important feature of the present invention is the ability to vary the value gradation and the amount of contrast to provide the desired illusion or appearance of thickness on the finished roof.

Figure 2:
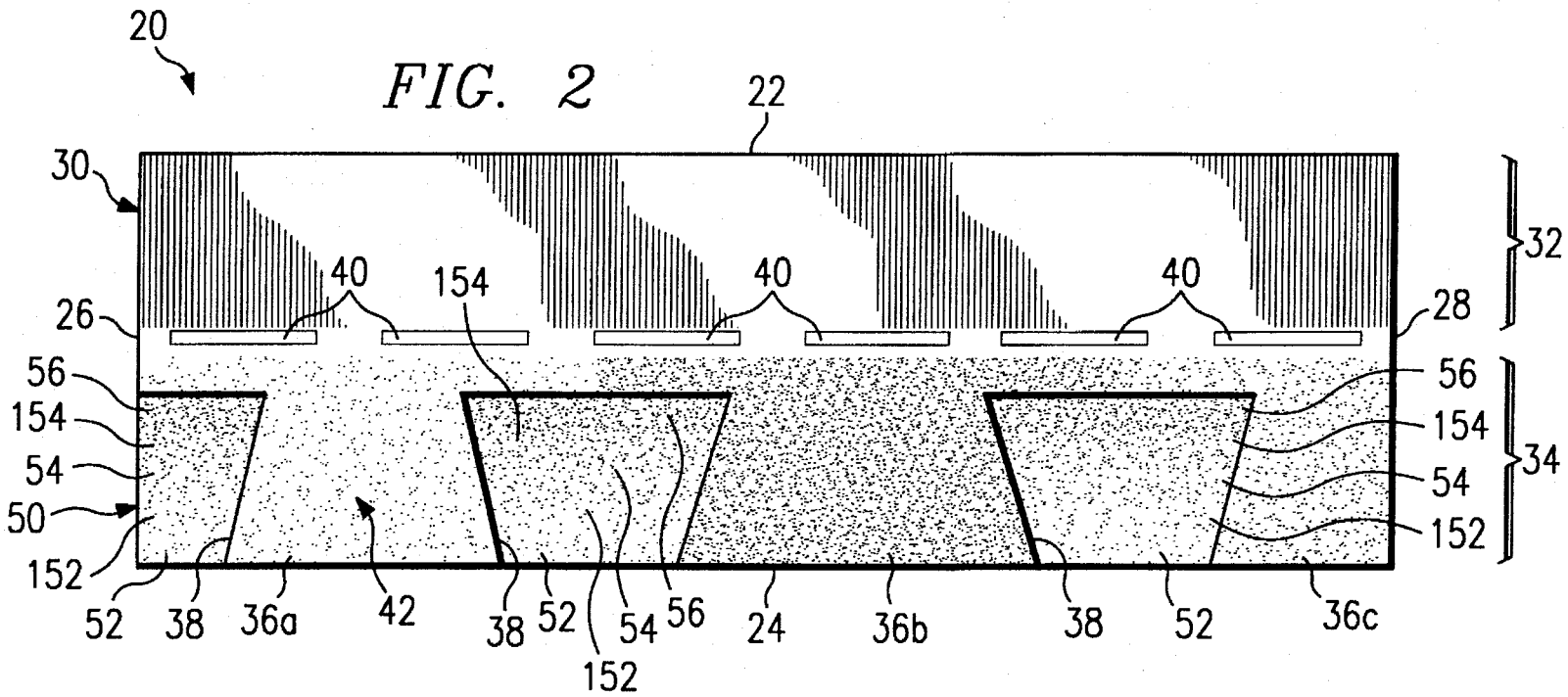
FIG. 2 is a top plan view of the shingle of FIG. 1.
Figure 3:
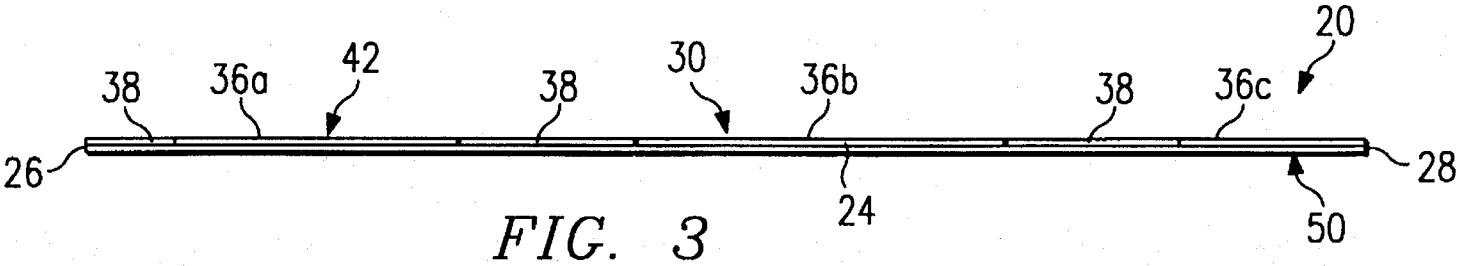
FIG. 3 is a front view of the shingle of FIG. 1.

As shown in FIGS. 1 and 2, second shingle sheet 50 preferably includes transition stripe 152 disposed between horizontal striations 52 and 54 and transition stripe 154 disposed between horizontal striations 54 and 56. The relationship between horizontal striations 52, 54 and 56 and the associate transition stripes 152 and 154 are more fully shown in FIG. 6B and 7B.

For some applications, an enhanced appearance of depth may be created on laminated shingle 20 by forming horizontal striation 52 from a relatively light value and horizontal striation 56 from a relatively dark value with a large difference in contrast between the light value and the dark value. The difference in colorimeter readings between the lightest value and the darkest value or the contrast between horizontal striations 52 and 56 may vary from approximately nine (9) to eighteen (18) depending on the selected generic color and its associated tone. Transition stripe 152 may be formed from a relatively uniform mixture of approximately fifty percent (50%) ceramic coated mineral granules associated with horizontal striation 52 and approximately fifty percent (50%) ceramic coated mineral granules associated with horizontal striation 54. In the same respect, transition stripe 154 may be formed from a relatively uniform mixture of the respective ceramic coated mineral granules used to form horizontal striations 54 and 56.

For other applications the ratio of ceramic coated mineral granules from adjacent horizontal striations may be varied from twenty-five percent (25%) to seventy-five (75%). The present invention allows the specific ratio of mineral granules used to form each transition stripe to be varied depending upon the specific color and value of the adjacent horizontal striations. Thus, the present invention allows the use of transition stripes 152 and 154 to provide a subtle gradation or change in value between the respective horizontal striations 52, 54 and 56.

For some applications, each horizontal striation 52, 54 and 56 along with the associated transition stripes 152 and 154, may be formed from mineral granules having the same generic color or tone, such as brown, gray, red, blue, yellow or black. Horizontal striations 52, 54 and 56 are preferably formed from the selected generic color having respective variations of the generic color with a light, medium and dark value. A colorimeter or other suitable testing equipment may be used to measure the value of light or dark contrast associated with horizontal striations 52 and 56 to evaluate the desired difference in value or contrast between the respective striations.

Generally, the greater the difference in contrast the more aesthetically appealing the resulting shingle. However, for some applications, a large difference in contrast or value between horizontal striations 52, 54 and 56 without an appropriate gradation in value between these striations will create a confused and disjointed appearance. The unpleasant appearance may be a striped or "zebra" effect. Therefore, an important feature of the present invention includes providing transition stripes 152 and 154 between the associated horizontal striations 52, 54 and 56. As will be explained later in more detail with respect to FIG. 8, transition stripe 152 may be formed from a relatively uniform mixture of ceramic coated minerals associated with horizontal striation 52 and ceramic coated minerals associated with horizontal striation 54. In a similar manner the ceramic coated minerals used to form transition stripe 154 may be a mixture of ceramic coated mineral granules associated with horizontal striation 54 and ceramic coated mineral granules associated with horizontal striation 56.

The acceptable difference in contrast between horizontal striations 52 and 56 depends in part upon the generic color and tone selected for the specific laminated shingle 20. For example, the preferred contrast in value for some color tones may be as high as eighteen (18) while for other color tones, the contrast value may be eight (8) or nine (9).

An important feature of the present invention includes the ability to vary the mixture of the ceramic coated mineral granules used to form transition stripes 152 and 154 to provide the desired subtle, gradual change in value between horizontal striations 52 and 56, while at the same time having a large value gradation. For a typical group of color tones, such as brown, gray, red, blue, yellow and black, an acceptable range of color contrast or value gradation may be from six (6) to eleven (11). By including transition stripes 152 and 154 between horizontal striations 52, 54 and 56, the acceptable range for the value gradation for the same family of colors may be increased from nine (9) to eighteen (18). Thus, the use of transition stripes in accordance with the teachings of the present inventions allows use of a higher value gradation for the same color tone as compared with previous techniques.

For purposes of illustration, tab **36*a* is shown having a relatively light value corresponding with horizontal striation 52. Tab 36*b* is shown having a relatively dark value corresponding with horizontal striation 56. Tab 36*c* is shown having a medium value corresponding with the value of horizontal striation 54. For other applications, each tab 36 may have essentially the same uniform value and/or color. Alternatively, tabs 36*a* and 36*c* may have the same value and/or color and tab 36*b* a different value and/or color. The present invention allows shingle 20 to have a weather surface 42 with enhanced value gradations represented by horizontal striations 52, 54 and 56 and their associated transition stripes 152 and 154 disposed between relatively uniform value portions represented by tabs 36*a*, 36*b* and 36*c***.

Figure 5:
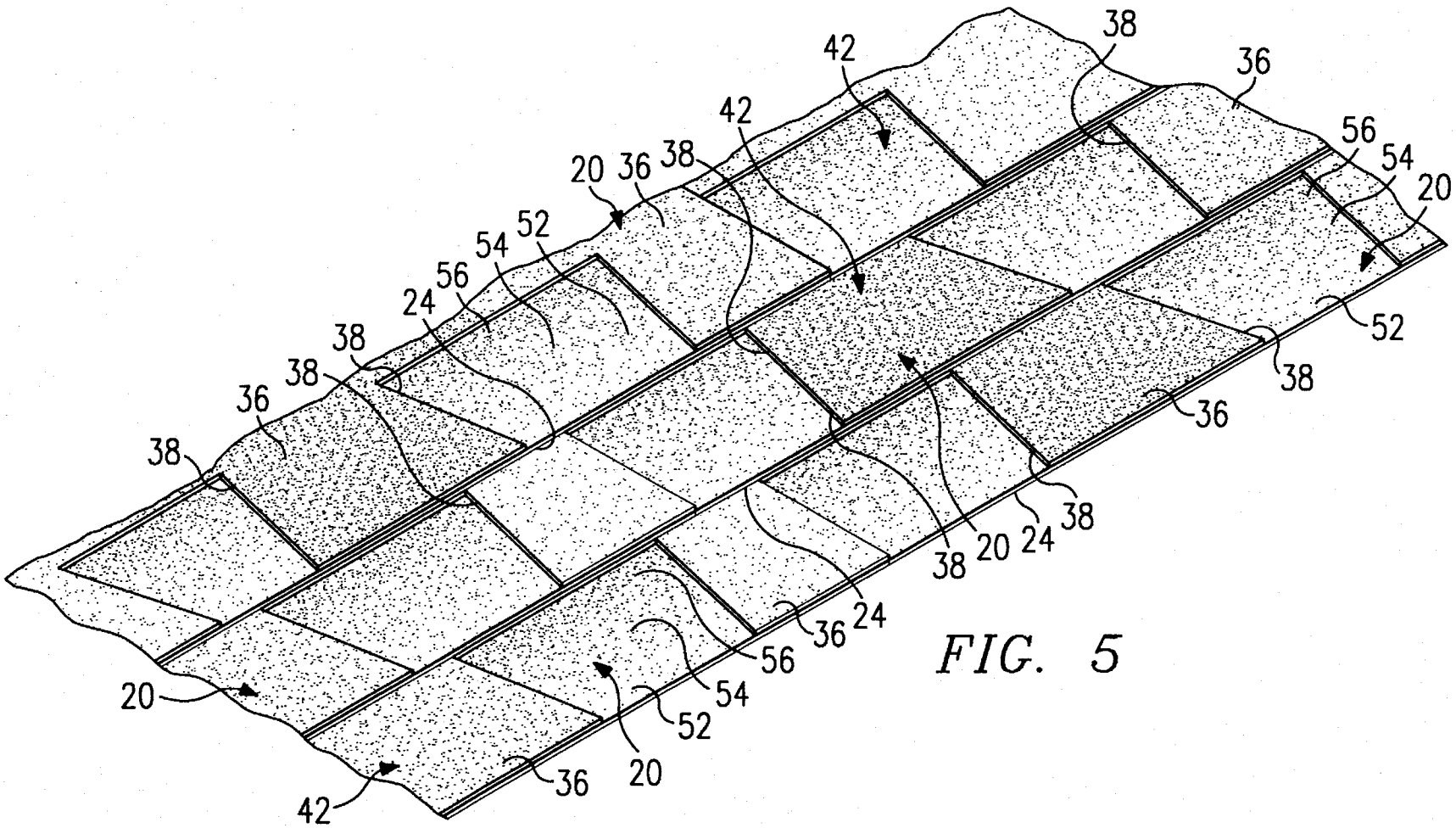
FIG. 5 is a perspective view of a partial roofing section covered with shingles incorporating one embodiment of the present invention.

As best shown in FIG. 5, a plurality of laminated shingles 20 may be installed on a roof or other structure (not shown)

to provide protection from the environment and to provide an aesthetically pleasing appearance. The normal installation procedure for laminated shingles 20 includes placing each shingle 20 on a roof with an overlapping configuration. Typically, buttlap section 34 of one shingle 20 will be disposed on the headlap section 32 of another shingle 20. Self-sealing adhesive strips 40 may be used to secure the overlapping shingles 20 with each other. Also, a limited lateral offset is preferably provided between horizontally adjacent rows of shingle 20 to provide an overall aesthetically pleasing appearance for the resulting roof.

Figures 6A, 6B:
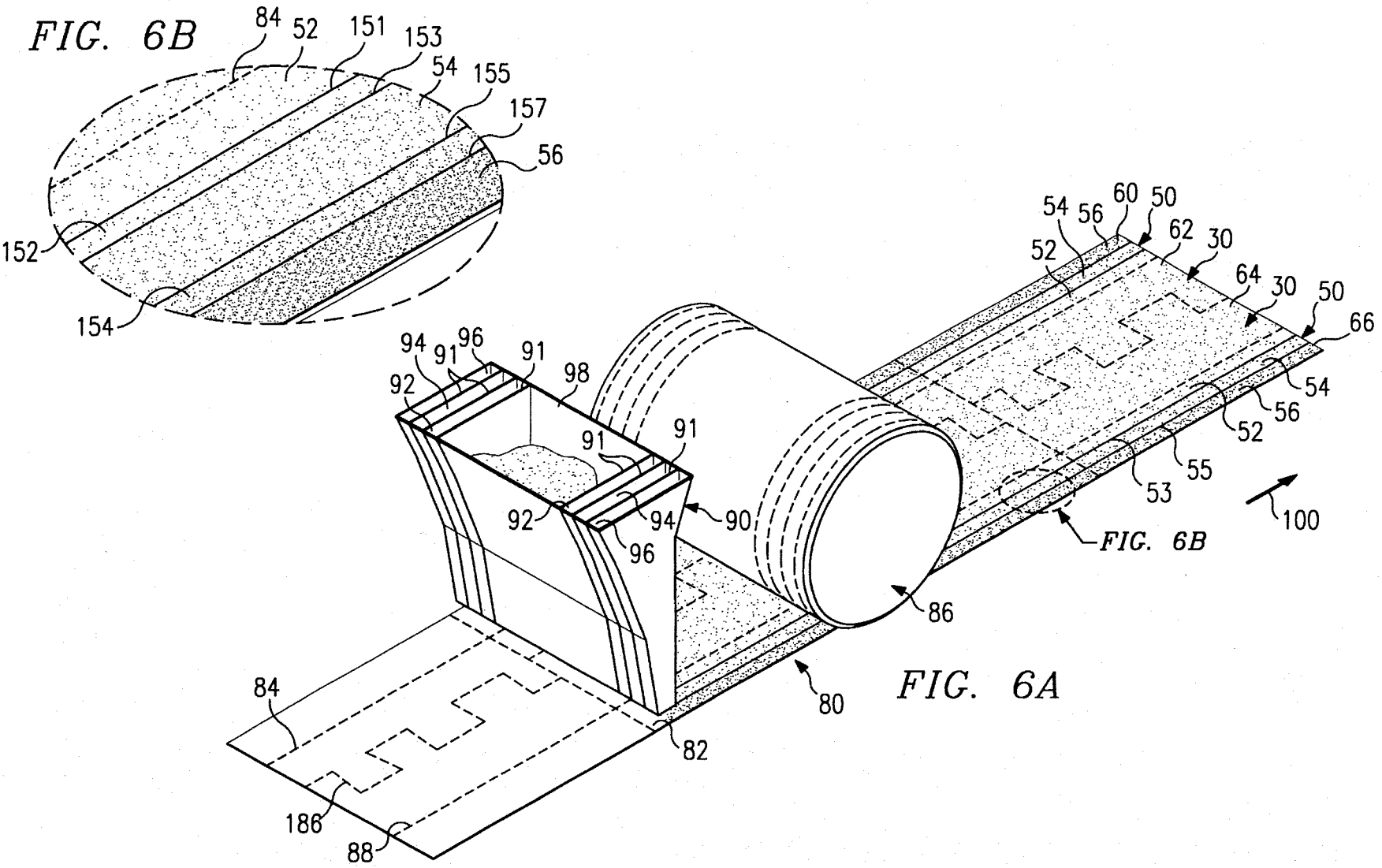
FIG. 6A is a schematic drawing with portions broken away of a sheet of roofing material incorporating one embodiment of the present invention from which components for the shingle of FIG. 1 may be obtained.
FIG. 6B is an enlarged drawing with portions broken away showing the sheet of roofing material in FIG. 6A with transition stripes disposed between adjacent horizontal striations.
Figure 7A:
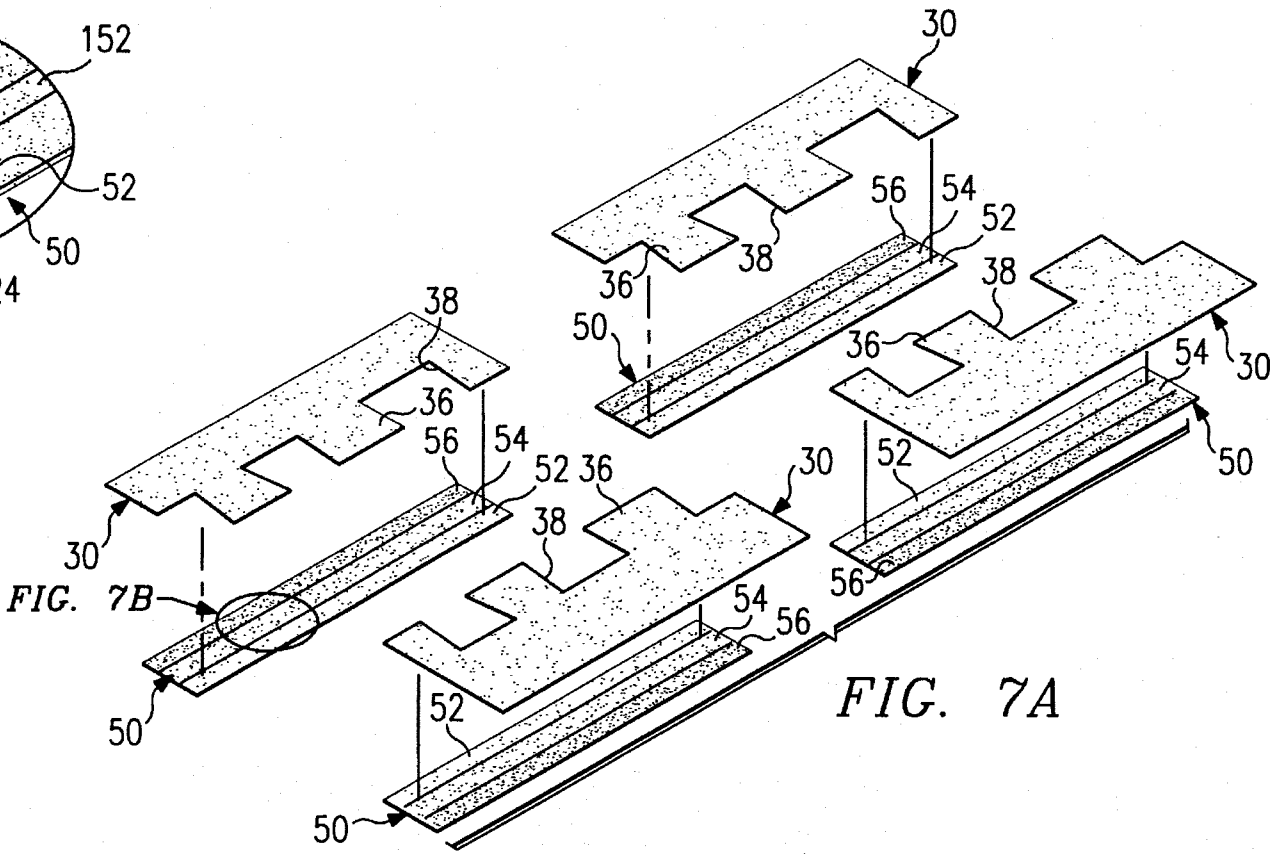
FIG. 7A is an exploded isometric view showing components taken from the sheet of roofing material in FIG. 6A which may be used to form the shingle of FIG. 1.
Figure 7B:
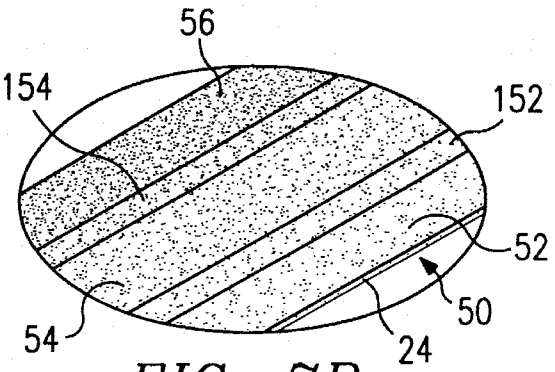
FIG. 7B is an enlarged drawing with portions broken away showing a second shingle sheet or backer strip of FIG. 7A with transition stripes disposed between adjacent horizontal striations.

FIGS. 6A and 7A illustrate portions of the procedures associated with fabricating laminated shingle 20 from sheet 80 of roofing material incorporating one embodiment of the present invention. Various procedures and methods may be used to manufacture sheet 80 of roofing material from which shingles incorporating the present invention may be fabricated. Examples of such procedures are contained in U.S. Pat. Nos. 1,722,702 entitled *Roofing Shingle*; U.S. Pat. No. 3,624,975 entitled *Strip Shingle of Improved Aesthetic Character*; U.S. Pat. No. 4,399,186 entitled *Foam Asphalt Weathering Sheet for Rural Roofing Siding or Shingles*; and U.S. Pat. No. 4,405,680 entitled *Roofing Shingle*. Each of these preceding patents is incorporated by reference for all purposes within this application.

Sheet 80 is preferably formed from a fiberglass mat placed on a jumbo roll (not shown) having a width corresponding to the desired sheet 80. Laminated shingles 20 are typically fabricated in a continuous process starting with the jumbo roll of fiberglass mat. As previously noted, laminated shingles 20 may also be fabricated using organic felt or other types of base material.

Sheet 80, as shown in FIG. 6A, preferably comprises a fiberglass mat with an asphalt coating which will both coat the fibers and fill any void spaces between the fibers. A powdered limestone stabilizer (not shown) may be included as part of the asphalt coating process. A smooth surface of various inert minerals of sufficient consistency may be placed on the bottom surface of sheet 80 to seal the asphalt coating. Top surface 82 is preferably covered with a layer of mineral granules such as ceramic coated stone granules to provide the desired relatively uniform color and/or value portions and the value gradation portions associated with weather surface 42 of shingle 20.

FIG. 6A shows a schematic representation of roller 86 and mineral granular hopper 90 which may be used to provide the desired granular surface coating for sheet 80. Arrow 100 shows the direction of travel for sheet 80. Hopper 90 includes a plurality of partitions 91 which divide hopper 90 into compartments 92, 94, 96 and 98. The larger compartment or central compartment 98 of hopper 90 may contain the mineral granules which will produce the desired color on dragon teeth or tabs 36 and the other portions of first shingle sheet 30 which will be exposed to the environment. The transfer of mineral granules from hopper 90 may sometimes be referred to as a "spill drop."

Figure 6C:
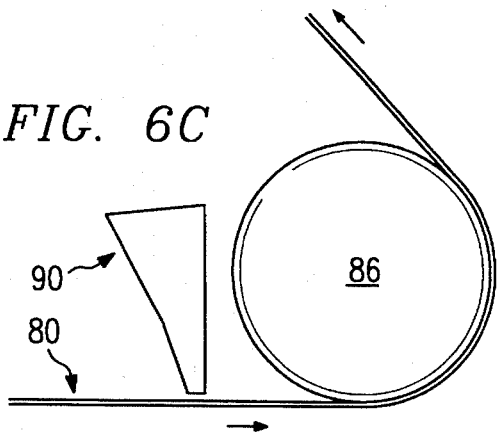
FIG. 6C is a schematic drawing with portions broken away showing one alternative embodiment to allow for recovery of loose mineral granules from the surface of the sheet of roofing material.

The present invention may be used with various types of granule storage, color mixers and granule blenders to provide various color drops on tabs 36 and/or headlap portion 32 as desired for the specific laminated shingle 20. Also, various types of rollers and/or granule blenders may be used to place mineral granules with the desired variations in value and/or color on top surface 82 of sheet 80. The present invention is not limited to use with hopper 90 and roller 86 as shown in FIG. 6A. For one application, multiple rollers may be used to form top surface 82. Also various types of granule recovery equipment (not shown) may be provided to collect any loose granules on top surface 82 and return them to hopper 90. FIG. 6C shows a schematic arrangement for one orientation of sheet 80 relative to roller 86 and hopper 80 to assist with the recovery of loose granules. Various other arrangements may be used as known in the art.

As previously noted transition stripe 152 is preferably disposed between horizontal striations 52 and 54 and transition stripe 154 is preferably disposed between horizontal striations 54 and 56. For purposes of illustration, only horizontal striations 52, 54 and 56 are shown in FIG. 6A with solid lines 53 and 55 disposed respectively therebetween. Solid lines 53 and 55 are typically not present on the actual backer strips 50. For one application, the nominal width of horizontal striations 52, 54 and 56, as shown in FIG. 6B, may be in the range of approximately 1.4 to 0.9 inches.

Transitions stripes 152 and 154, as best shown in FIG. 6B, are preferably disposed between respective horizontal striations 52, 54 and 56. For one application of the present invention, transition stripes 152 and 154 preferably have a width of approximately one inch. The centerline of transition stripe 152 will preferably correspond approximately with line 53 between horizontal striations 52 and 54. The centerline of transition stripe 154 will preferably correspond approximately with line 55 between horizontal striations 54 and 56. For purposes of illustration, only solid lines 151 and 153 are shown in FIG. 6B to more clearly identify transition stripe 152. In the same respect, solid lines 155 and 157 are shown in FIG. 6B to more clearly define transition stripe 154. In actual practice, solid lines 151, 153, 155 and 157 are typically not formed on the respective backer strip 50.

For the embodiment of the present invention shown in FIGS. 6A and 7A, each first shingle sheet 30 may have the same mixture of mineral granules on both the headlap section and the buttlap section. For the embodiment shown in FIGS. 1 through 4 headlap section 32 may have the same layer of mineral granules as buttlap section 34 or headlap section 32 may have a neutral or noncolored layer of mineral granules. As previously noted, an important feature of the present invention includes providing at least one portion of weather surface 42 having a relatively uniform value and/or color and another portion of weather surface 42 having an enhanced value gradation from light to dark to create the appearance of depth or thickness on the associated portion of weather surface 42. The surface layer on headlap section 32 may be varied as desired for each application.

Different colored mineral granules corresponding to the desired horizontal striations 52, 54 and 56 may be placed in the appropriate compartments 92, 94 and 96 for one embodiment of the present invention. As sheet 80 passes under hopper 90, mineral granules from the appropriate compartment in hopper 90 will fall onto top surface 82 of sheet 80. Roller 85 will then press the mineral granules into the associated asphalt coating. The volume or pounds per square foot of mineral granules placed on surface 82 is preferably the same throughout the full width of sheet 80. However, by dividing hopper bin 90 into compartments, the color and/or value of various portions of sheet 80 may be varied including providing horizontal striations 52, 54, and 56 and transition stripes 152 and 154 for backer strip 50.

It is important to note that conventional procedures for fabricating shingles having an exterior surface formed by mineral granules include the use of granule blenders and color mixers, along with sophisticated equipment to ensure a constant uniform color drop at each location on the exposed portions of the shingles. Extensive procedures are used to ensure that each color drop on a sheet of roofing material is uniform. The color drop between shingles may be varied to provide different shades or tones in color. However, within each color drop, concerted efforts have traditionally been made to insure uniformity of the color on the resulting shingle associated with each color drop.

As shown by dotted lines 84, 186, and 88 in FIG. 6A, sheet 80 may be cut into four horizontal lengths or lanes 60, 62, 64, and 66. The width of lanes 62 and 64 is selected to correspond generally with the desired width for first shingle sheet 30. The width of lanes 60 and 66 is selected to correspond generally with the desired width for second shingle sheet 50. Lanes 60, 62, 64, and 66 may then be cut laterally to correspond with the desired length for the resulting first shingle sheet 30 and second shingle sheet 50. The rotation of roller 86 and the movement of sheet 80 are coordinated to place the desired color drop or drops on each shingle 20.

The cut along dotted line 186 corresponds with the desired pattern for dragon teeth 36 and associated openings 38. For some applications, eight lanes may be cut from a sheet of roofing material similar to sheet 80. The number of lanes is dependent upon the width of the respective sheet of roofing material and the desired width of the resulting shingles.

As shown in FIG. 7A, each lateral cut of sheet 80 will typically result in two backer strips 50 and two first shingle sheets 30 which may be assembled with each other to form two laminated shingles 20. The resulting laminated shingles 20 are then packaged with the desired color configuration for future installation on a roof.

Figure 8:
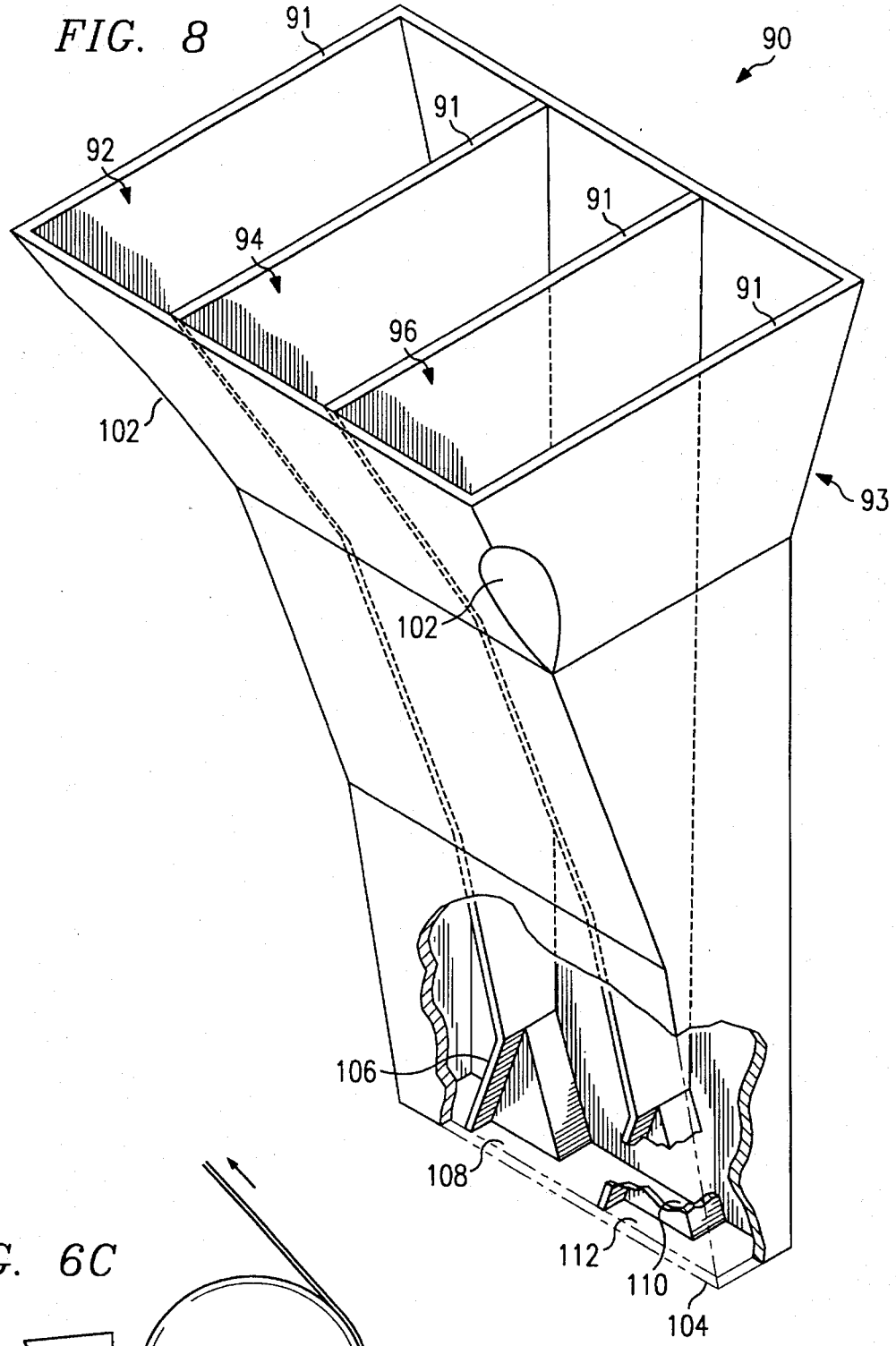
FIG. 8 is an isometric drawing showing portions of a hopper which may be used to form transition stripes between adjacent horizontal striations in accordance with one embodiment of the present invention.

FIG. 8 shows a portion of hopper 90 represented by splitter 93 which may be satisfactorily used to place mineral granules on sheet 80 to form horizontal striations 52, 54 and 56 along with the associated transition stripes 152 and 154. Outlet end 104 of splitter 93 has been modified in accordance with the teachings of the present invention to provide the desired mixture of color granules associated with each transition stripe 152 and 154.

For the specific example shown in FIG. 8, partition 91 between compartments 92 and 94 includes a pair of diverters with respective openings 106 and 108. An important feature of the present invention includes the ability to adjust the geometric configuration and the dimensions associated with diverters and openings 106 and 108 to vary the percentage of mineral granules from the respective compartments 92 and 94 which will form transition stripe 152. In a similar manner, partition 91 between compartments 94 and 96 includes a pair of diverters and respective openings 110 and 112 to regulate the percentage of mineral granules from the respective compartments 94 and 96 which form transition stripe 154. As previously noted for one application, transition stripes 152 and 154 preferably include approximately an equal mixture of mineral granules from the respective compartments 92, 94 and 96. However, the geometric configuration and dimensions of the diverters and their respective openings 106, 108, 110 and 112 may be varied to adjust the ratio of mineral granules from the respective compartments 92, 94 and 96 which form transition stripes 152 and 154. Also, various mechanisms other than splitter 93 may be satisfactorily used to form transition stripes 152 and 154.

It is important to note that an enhanced value gradation of the present invention may be placed on shingles using various procedures and various types of materials. The present invention is not limited to shingles formed by the process shown in FIGS. 6A and 7A.

Although the present invention and its advantages have been described in detail, it should be understood that various changes, substitutions and alterations can be made therein without departing from the spirit and scope of the invention as defined by the appended claims.

What is claimed is:

1. A shingle having an exposed weather surface comprising:

at least one portion of the weather surface having a relatively uniform color-value;

an adjacent portion of the weather surface having a color-value gradation from light to dark formed in part by a plurality of horizontal striations with each striation having a different color-value as compared to an adjacent striation to create the appearance of depth on the weather surface;

a transition stripe disposed between each pair of adjacent striations to provide a portion of the color-value gradation and each transition stripe having a color-value comprising a mixture of the respective colors associated with the horizontal striations disposed on either side of each transition stripe, the color-value gradation of said horizontal striations having an enhanced difference between light to dark color-values and said transition striped providing a gradual change in color-value between the respective horizontal striations; and the color-value gradation comprises the plurality of horizontal striations and the associated transition stripes each having a selected contrast to establish the desired gradation in color-value.

2. The shingle of claim 1 wherein the color-value gradation comprises three horizontal striations.

3. The shingle of claim 1 wherein the color-value gradation comprises each horizontal striation having a width selected from the range consisting of approximately 0.9 to 1.4 inches and each of the transition stripes disposed between adjacent horizontal striations having a width of approximately one inch.

4. The shingle of claim 1 further comprising:

a laminated roofing shingle having a first shingle sheet with a plurality of tabs extending therefrom and openings disposed between the tabs;

a second shingle sheet disposed under the tabs and a portion of the second shingle sheet exposed in each of the openings between the tabs;

the weather surface formed in part by the tabs and the portions of the second shingle sheet which are exposed by the openings between adjacent tabs;

each tab having a layer of colored mineral granules that give the tab a relatively uniform color-value;

a layer of mineral granules forming the color-value gradation on the second shingle sheet between the tabs;

each horizontal striation formed by colored mineral granules having a different color-value as compared to adjacent horizontal striations; and each transition stripe formed by an approximately equal mixture of the colored mineral granules used to form the horizontal striations on opposite sides of the respective transition stripe.

5. The shingle of claim 1 further comprising:

a first sheet having a generally rectangular configuration with a plurality of tabs extending therefrom and openings disposed between the tabs;

a second sheet having a generally rectangular configuration disposed under the tabs and a portion of the second shingle sheet exposed in each of the openings between the tabs;

the weather surface formed in part by the tabs and the portions of the second shingle sheet which are exposed by the openings between adjacent tabs;

each tab having a respective generally uniform color-value; and the color-value gradation disposed on the second shingle sheet between the tabs with a lighter color-value at the lower edge of the second shingle sheet and a darker color-value adjacent to the upper portion of each opening.

6. The shingle of claim 1 further comprising:

a laminated roofing shingle having a first shingle sheet with a plurality of tabs extending therefrom and openings disposed between the tabs;

a second shingle sheet disposed under the tabs and a portion of the second shingle sheet exposed in each of the openings between the tabs;

the weather surface formed in part by the tabs and the portions of the second shingle sheet which are exposed by the openings between adjacent tabs;

the relatively uniform color-value portion represented by each of on the tabs; and the color-value gradation formed on the second shingle sheet.

7. The shingle of claim 6 wherein the second shingle sheet comprises three horizontal striations with each striation having a different color-value to establish the desired gradation in color-value from light to dark.

8. A laminated shingle having a first shingle sheet with a plurality of tabs and a second shingle sheet comprising:

each of the tabs having a relatively uniform color-value portion;

an opening formed between adjacent tabs;

the second shingle sheet disposed beneath the tabs with a portion of the second shingle sheet exposed through the respective openings;

a color-value gradation from light to dark formed on the exposed portion of the second shingle sheet by a plurality of horizontal striations with each striation having granules with a different color-value as compared to an adjacent striation to create an appearance of depth in cooperation with the tabs forming the respective openings;

a transition stripe disposed between adjacent striations and each transition stripe having a color-value comprising a mixture of the respective granules of the horizontal striations disposed on either side of each transition stripe whereby the color-value gradation has an enhanced difference between light to dark color-values while at the same time providing a gradual change in color-value between the respective horizontal striations; and the mixture of granules for each transition stripe varying from 25% to 75% of the respective granules of the horizontal striation disposed on either side of the respective transition stripe.

9. The laminated shingle of claim 8 further comprising each transition stripe on the second shingle sheet having an approximately equal mixture of the respective granules of the horizontal striation disposed on either side of each transition stripe to establish the color-value gradation on the second shingle sheet.

10. The laminated shingle of claim 8 wherein the horizontal striations further comprise one striation having a lighter color-value and an adjacent striation having a darker color-value to establish the color-value gradation.

11. The laminated shingle of claim 8 further comprising three horizontal striations formed on the second shingle sheet to establish the color-value gradation from light to dark.

12. The laminated shingle of claim 8 further comprising:

a weather surface defined in part by the tabs and the portions of the second shingle sheet exposed through the associated opening between adjacent tabs;

the weather surface having a layer of mineral granules disposed thereon;

the mineral granule layer on each tab having a relatively uniform color-value; and the plurality of horizontal striations on the second sheet providing the color-value gradation from light to dark.

13. The laminated shingle of claim 8 further comprising a variation in color-value between adjacent tabs.

14. The laminated shingle of claim 8 further comprising a variation in the color-value gradation between portions of the second shingle sheet exposed through the respective openings.

15. A laminated roofing shingle for enhancing the appearance of depth of the shingle comprising:

a first shingle sheet having a plurality of tabs extending from an edge thereof, the tabs spaced apart to define a plurality of openings between the tabs;

the color of the tabs being relatively uniform in value throughout each tab;

a second shingle sheet disposed beneath and attached to the underside of the first shingle sheet to form a two-ply laminated shingle, with portions of the second shingle sheet being exposed through the openings between the tabs;

a plurality of horizontal striations on said second shingle sheet providing a color-value gradation across the portions of the second shingle sheet which are exposed through the openings between the tabs;

a transition stripe disposed between each pair of adjacent striations and each transition stripe having a color-value comprising a mixture of the respective colors associated with the horizontal striations disposed on either side of each transition stripe, the color-value gradation of said horizontal striations having an enhanced difference between light to dark color-values and said transition stripes providing a gradual change in color-value between the respective horizontal striations;

the color-value mixture of granules for each transition stripe varying from 25% to 75% of the respective color-value of the horizontal striation disposed on either side of the respective transition stripe;

each of the striations providing a generally elongated area disposed within the portions of the second sheet, each of the striations having a color-value substantially uniform throughout its respective generally elongated area with each of the generally elongated areas being approximately equal in size;

one of the striations occupying the top of the portions of the second shingle sheet and another of the striations occupying the bottom of the portions of the second shingle sheet with the striations occupying the bottom of the portions of the second sheet having a lighter color-value than the color-value of the striations occupying the top of the portions of the second shingle sheet; and the plurality of horizontal striations and associated transition stripes providing the color-value gradation over each of the portions of the second shingle sheet which are exposed through the openings between the tabs, such that an appearance of shingle depth is created by the combined visual appearance of the color-value contrasts and gradations provided by the first and second shingle sheets.

16. The laminated roofing shingle of claim 15 wherein different tabs have different color-contrasts from one another.

17. The laminated roofing shingle of claim 15 wherein the dimensions of one of the tabs and the openings formed thereby differ from the dimensions of others of the tabs and the openings formed thereby.

18. A laminated roofing shingle for enhancing the appearance of depth of the shingle comprising:

a first shingle sheet having a plurality of tabs extending from an edge thereof, the tabs spaced apart to define a plurality of openings between the tabs;

the color-value of the tabs being relatively uniform throughout each tab;

a second shingle sheet disposed beneath and attached to the underside of the first shingle sheet to form a two-ply laminated shingle, with portions of the second shingle sheet being exposed through the openings between the tabs;

first, second and third horizontal striations on said second shingle sheet providing a color-value gradation across the portions of the second sheet which are exposed through the openings between the tabs;

the first striation providing an elongated, generally quadrilateral area and occupying the top of the portions of the second sheet, the first striation having a color-value substantially uniform throughout the generally quadrilateral area;

the second striation providing an elongated, generally quadrilateral area approximately equal to the area of the first striation, the second striation occupying the middle of the portions of the second sheets, the second striation having a color-value lighter than the color-value of the first striation and the light color-value being substantially uniform throughout the generally quadrilateral area;

the third striation providing an elongated, generally quadrilateral area occupying the bottom of the portions of the second sheet, the third striation having a lighter color-value than the color-value of the second striation and the lighter color-value being substantially uniform throughout the generally quadrilateral area;

a first transition stripe disposed between the first striation and the second striation with the first transition stripe having a color-value comprising a mixture of the respective color-values of the first striation and the second striation, the color-value gradation of said first and second horizontal striations having an enhanced difference between lighter to darker color-value and said transition stripe providing a gradual change in color-value between the first striation and the second striation;

a second transition stripe disposed between the second and the third striations with the second transition stripe having a color-value comprising a mixture of the respective color-values of the second striation and the third striation, the color-value gradation of said second and third horizontal striations having an enhanced difference between lighter to darker value and said transition stripe providing a gradual change in color-value between the second striation and the third striation; and the first, second and third horizontal striations and associated transition stripes providing the color-value gradation over each of the portions of the second shingle sheet which are exposed through the openings between the tabs, such that an appearance of shingle depth is created by the combined visual appearance of the color-value gradations provided by the first and second shingle sheets and the adjacent tabs.

19. The laminated roofing shingle of claim 18 wherein different tabs have different color-values from one another.

20. The laminated roofing shingle of claim 18 wherein the dimensions of one of the tabs and the openings formed thereby differ from the dimensions of others of the tabs and the openings formed thereby.

21. The laminated shingle of claim 18 and further comprising a variation in color-value between adjacent tabs.

22. A method of fabricating a two-ply laminated roofing shingle with an enhanced appearance of depth on exposed portions of the shingle comprising the steps of:

forming a first shingle sheet having a plurality of tabs extending from one edge thereof;

spacing the tabs from each other to define a plurality of openings between the tabs;

forming a respective relatively uniform color-value portion on each of the tabs;

forming the laminated shingle by disposing a second shingle sheet beneath and attached to the underside of the first shingle sheet with portions of the second shingle sheet exposed through the openings formed by the tabs;

placing colored granules on the second shingle sheet to form a plurality of horizontal striations on the second shingle sheet to provide a color-value gradation across the portions of the second shingle sheet which are exposed through the openings;

placing a transition stripe between each pair of adjacent horizontal striations with each transition stripe having a color-value comprising a mixture of the respective granules associated with the horizontal striations disposed on either side of the respective transition stripe, the color-value gradation of said horizontal striations having an enhanced difference from light to dark color-values and said transition stripes providing a gradual change in color-value between the respective horizontal striations;

forming each of the respective horizontal striations with a substantially uniform color-value;

placing one of the horizontal striations having a dark color-value near the top of the portions of the second shingle sheet and placing another of the horizontal striations near the bottom of the portions of the second shingle sheet with the striation occupying the bottom of the portions having a lighter color-value than the color-value of the striations occupying the top of the portions of the second shingle sheet; and providing the enhanced color-value gradation over each of the portions of the second shingle sheet which are exposed through the openings between the tabs by the combined visual appearance of the horizontal striations and the associated transition stripes such that an appearance of shingle depth is created by the resulting color-value gradations provided by the first and second shingle sheets.

23. The method of claim 22 further comprising the step of providing different values of color on each of the respective tabs.

24. The method of claim 22 further comprising the steps of:

forming the horizontal striations with color coated ceramic granules; and forming the respective transition stripes from a mixture of approximately 50% of the color coated ceramic granules used to form the horizontal striation on one side of the respective transition stripe and approximately 50% of the color coated ceramic granules used to form the horizontal striation disposed on the opposite side of the respective transition stripe.

25. The method of claim 22 further comprising the steps of:

forming each horizontal striation from ceramic coated mineral granules having a different value of color for each horizontal striation;

forming each transition stripe from a mixture of the ceramic coated mineral granules used to form the horizontal striations disposed on either side of the respective transition stripes; and varying the ratio of the ceramic coated mineral granules used to form the respective transition stripe from 25% to 75% of the ceramic coated minerals used to form the horizontal striations disposed on either side of the respective transition stripe.

* * * * *